United States Patent [19]

Kamata

[11] Patent Number: 4,513,208

[45] Date of Patent: Apr. 23, 1985

[54] ELECTRICAL SWITCHGEAR

[75] Inventor: Isao Kamata, Sagamihara, Japan

[73] Assignee: Tokyo Shibaura Denki Kabushiki Kaisha, Kawasaki, Japan

[21] Appl. No.: 582,765

[22] Filed: Feb. 23, 1984

[30] Foreign Application Priority Data

Feb. 28, 1983 [JP] Japan ..... 58-31024

[51] Int. Cl.[3] ..... H01H 71/04; H01H 33/00

[52] U.S. Cl. ..... 307/139; 200/148 R; 361/115

[58] Field of Search ..... 250/231 P, 231 R, 231 SE; 307/116-118, 144; 361/115, 173-177; 200/148 A, 148 F, 308, 310, 317

[56] References Cited

U.S. PATENT DOCUMENTS 3,780,349 12/1973 Nitta et al. ..... 361/115
4,016,384 4/1977 LeRow, Jr. et al. ..... 200/308 X
4,110,578 8/1978 Freeman et al. ..... 200/148 F

FOREIGN PATENT DOCUMENTS 56-29424 3/1981 Japan .

*Primary Examiner*—A. D. Pellinen
*Assistant Examiner*—Todd E. DeBoer
*Attorney, Agent, or Firm*—Oblon, Fisher, Spivak, McClelland & Maier

[57] ABSTRACT

An electrical switchgear having a position detector that detects the state of actuation of switch contacts and a position detector which judges the locking engagement condition of the switch contacts, wherein these position detectors are connected with an optical control unit by an optical cable.

5 Claims, 10 Drawing Figures

ELECTRICAL SWITCHGEAR

BACKGROUND OF THE INVENTION

1. Field of the Invention:

The present invention relates to an electrical switchgear and more particularly to an electrical switchgear with an improved control section of an operating unit.

2. Description of the Prior Art:

Gas insulated switchgears have been used for power stations, substations and switching stations in the vicinity of large cities and coastal areas. Insulating gas is sealed in a grounded tank portion of the gas insulated switchgear. FIG. 1, for example, is a side view of the gas insulated switchgear. It shows a bushing a, a main bus b, a disconnecting switch 63, an operating unit 9 and a control panel c. The operating unit 64 is disposed for operating a contact in the grounded tank, and the control panel c is used for signal transmission and reception with operating unit 9. The switches that make up such gas insulated switchgear comprise a pair of separable contacts accommodated in the grounded tank and a switch mechanism for operating these contacts and the operating unit. Since this operating unit is placed in the atmosphere, the components used in it may be affected by changes in the environment in which the gas-insulated switchgear is placed. In fact most of the troubles with existing gas-insulated switchgears originate in the vicinity of the operating unit. Specifically, in order to extract various signals for obtaining data when the gas-insulated switchgear is operated, the operating unit includes an auxiliary switch that emits the main device actuating signal, a limit switch for emitting a drive source control signal on detection of completion of the actuation of the main device, an interlock device that sets the locked condition of the manually operated switch in response to detection of the state of neighboring apparatus, a pressure switch that detects fluid pressure, which is a condition for locking the operation to safeguard the switch duty, and a density switch which detects the minimum guaranteed pressure of the insulating gas. The following problems, resulting from environmental conditions, may be anticipated in the contacts etc. that generate these electrical signals:

(1) Decrease of insulation resistance due to poor conduction or deterioration of the insulating parts resulting from corrosion of the contact parts due to corrosive gas present in the air.

(2) Undesired contact of the various contacting points due to vibration during operation of the switch, and spurious signals etc. due to chattering.

(3) Breakdown of the insulation caused by main circuit surges due to the switching operation of the gas-insulated switchgear switches being induced in the earthed tank and entering the control circuit part of the operating unit.

As mentioned above, an isolator switchgear requires as indispensable components a plurality of detection means comprising various electrical contacts. This is the major cause of the complexity of the operating unit. Also, in prolonged operation of the gas-insulated switchgear, damage to these contacts from atmospheric conditions such as salt, dust and corrosive gases, is unavoidable. Such damage can prevent the control circuit from operating, thus making operation impossible. A further problem is that an electrical wiring control cable is necessary to connect these electrical contacts to the control panel. This control cable is easily affected by the surge produced on switching the main circuit, because the surge, when induced into the control circuit, which operates at low voltage, may lead to destruction of components or spurious operation. Lastly, an appreciable amount of vibration is produced when the operating unit performs the switching operation, and this vibration may cause spurious operation of the various electrical contacts.

SUMMARY OF THE INVENTION

The object of the present invention is to provide an electrical switchgear wherein there is no risk of spurious operation due to wear of the structural components of the operating unit due to protracted operation or changes in the environment, or vibration during the switching operation, or of adverse effects due to surges of the main circuit on switching, and wherein only a small amount of wiring is required between the operating unit and the control panel.

In order to achieve these objects, the present invention provides that a position detector which detects the state of actuation of the switch contacts and a position detector which determines the locking condition of the switch are linked to an optical control unit associated with the control panel by means of a light cable. Within this optical control unit the light signals from the detectors are converted to electrical signals, the output signal from this optical control unit is fed to an A/D converter, and control of the drive source and the necessary verification of actuation are performed by the output from this A/D converter. Thus this electrical switch utilizes no electrical contacts associated with the operating unit which might present a risk of spurious operation or wear.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
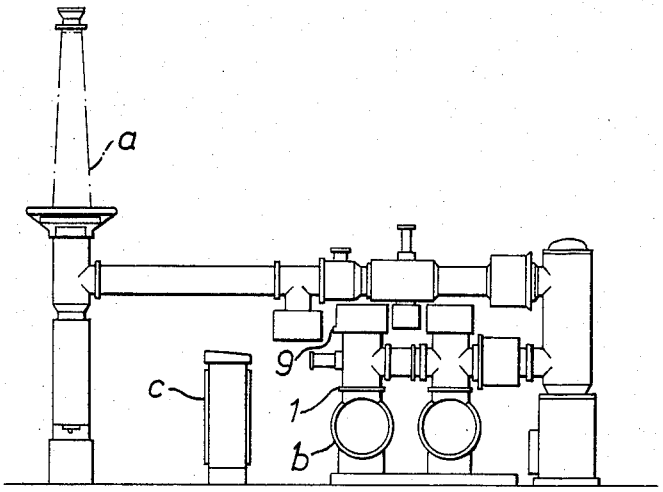
FIG. 1. PRIOR ART
FIG. 1 is a side view of a prior art gas insulated switchgear.
Figure 2:
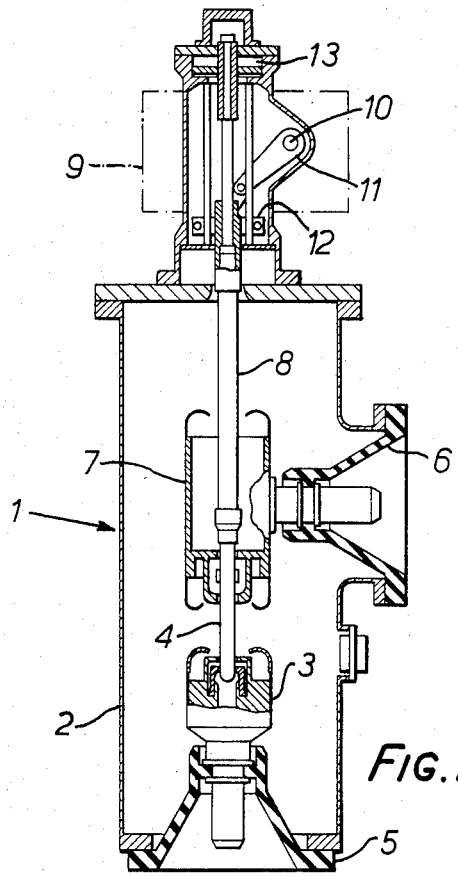
FIG. 2 is a cross-sectional view of a disconnecting switch according to the embodiment of the present invention.

Referring now to the drawings, wherein like reference numerals designate identical or corresponding parts throughout the several views. FIG. 2 is a cross-sectional view of a disconnecting switch according to the embodiment of the present invention.

Figure 3:
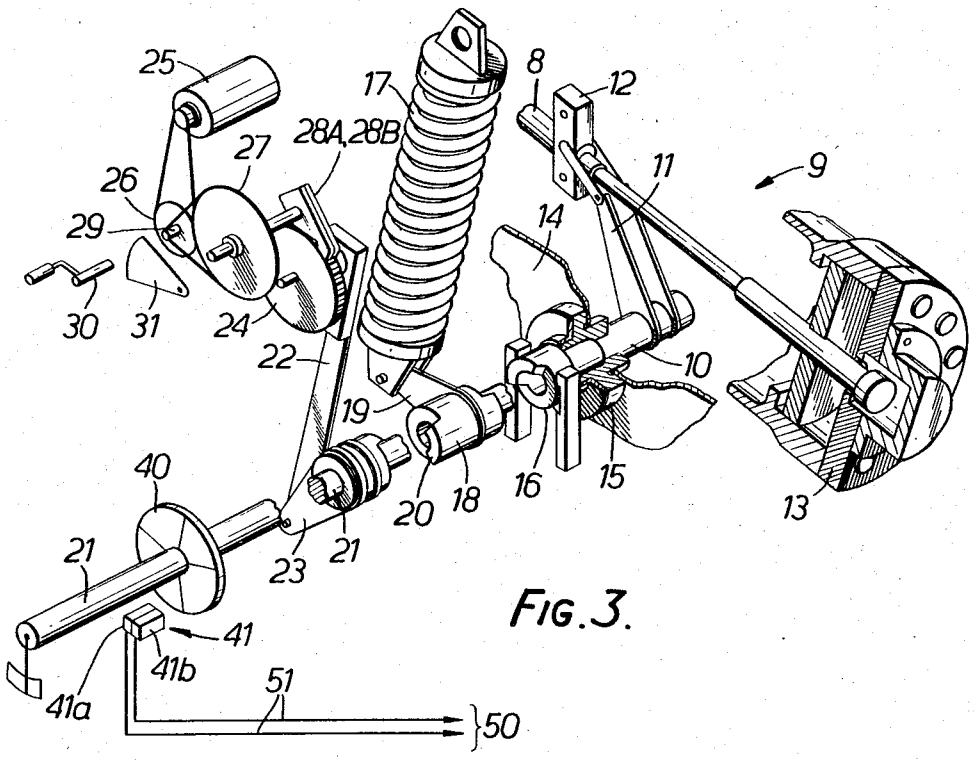
FIG. 3 is a perspective view of an operating unit of a disconnecting switch according to the embodiment of the present invention.

A disconnecting switch 1 comprises a grounded tank 2 within which is sealed insulating gas and which accommodates a switching part made up of oppositely arranged fixed and movable contacts 3 and 4. The fixed contact 3 is fixedly supported at the center of an insulating spacer 5 fixed to the grounded tank 2, and the movable contact 4 is likewise slidably supported on a movable conductor 7 that is supported on an insulating spacer 6. The movable contact 4 is connected to an operating unit 9 outside the grounded tank 2, by means of an insulating rod 8. This switch mechanism consists of a main shaft 10 turned by a drive source shown in FIG. 3, a link 11 linked to the end of insulating rod 8, a guide 12 that guides the insulating rod 8, and a dash pot 13. As shown in FIG. 3, the main shaft 10 is freely rotatably supported on the casing 14 of the operating unit 9 by means of a bearing 15 and is connected, through a link cam 16, to a drive spring 17 at the end on the opposite side to the link 11. This drive spring 17 is mounted by means of a lever 19 on a spring shaft 18 provided as an extension of the shaft 10 so that when the spring shaft 18 rotates, the greatest compression occurs when the lever 19 is directly above. On this spring shaft 18, at the opposite end to the the main shaft 10, there is provided a drive shaft 21 through the intermediary of a link cam 20. This drive shaft 21 is linked to a wheel 24 through link 22 and lever 23. This wheel 24 meshes with two ratches 28*a* that move synchronously with a wheel 27 that is linked to the motor 25 through a reduction gear 26.

Figure 4:
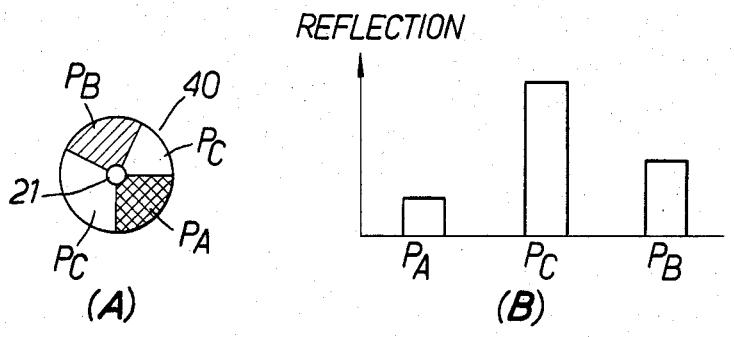
FIG. 4(A) is a side view of a disk according to the embodiment of the present invention, (B) is a graph detailing reflected light from the disk.

There is provided a position detector 41 that detects the switching position of the switch contacts on the drive shaft 21 which is coaxially arranged with the main shaft 10. This switch contacts position detector 41 detects the angle of rotation of the main shaft 10 or the position of the insulating rod 8 of the contacts, which is driven by the main shaft 10, in the form of an optical signal. This position detector 41 is connected by means of an optical cable 51 to an optical control unit 50 provided in the control panel 65, which is in a position remote from the mechanical part of the operating unit 9. A colored disk 40 is fixed with the drive shaft 21. The position detector 41 that detects the switching position of the disconnecting switch is disposed on the opposite side of the main shaft 10. The position detector 41 is a detector wherein when light is shown on the coatings of different colors depending on position which are applied to the surface of the colored disk 40 from a light-transmission part 41*a*, the amount of light that is reflected, which depends on the position of the main shaft or the operating rod, is detected by a light-reception part 41*b*. The detector 41 is connected with the control unit 50 by means of the optical cable 51. Paints $P_A$, $P_B$, $P_C$ are coated on the surface of the disk 40 as shown in FIG. 4(*a*). The light reflection is greater from the part of the disk which contains the painted portion $P_C$ as shown in FIG. 4(B).

Figure 5:
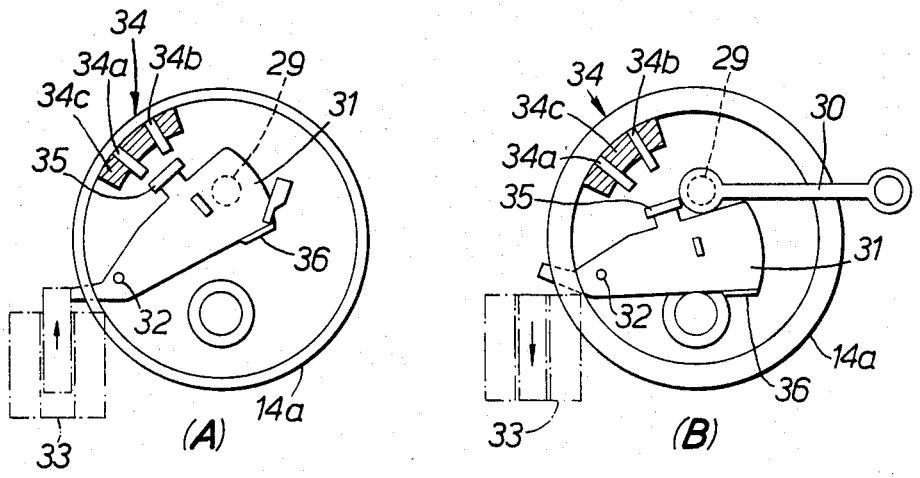
FIG. 5 is an enlarged elevational view of a manual operating portion of the operating unit according to the embodiment of the present invention.
Figure 6:
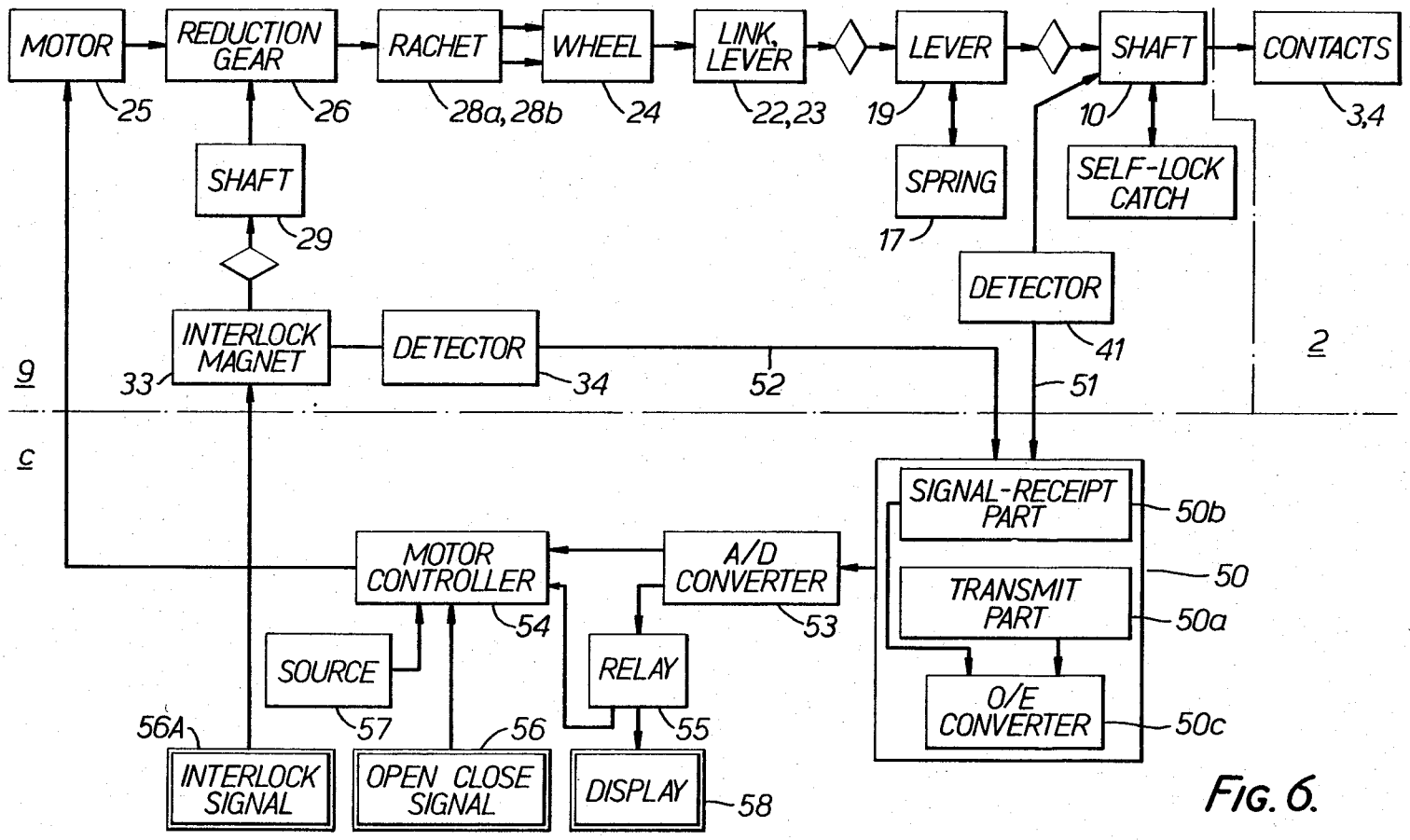
FIG. 6 is a block diagram of a disconnecting switch according to the embodiment of the present invention.

A position detector 34, detailed in FIG. 5 which detects the setting of the locked condition for making possible manual operation of the isolator is connected to the optical control unit 50 by means of an optical cable 52 as shown in FIG. 6.

The reduction gear 26 in FIG. 3 is provided with a manual operating shaft 29 so that, in manual switch operation on site, the wheel 27 can be rotated by means of a manual handle 30. This manual operating shaft 29 is normally covered by a shutter 31. As shown in FIG. 5(A) and (B), the shutter 31 is freely rotatably mounted with respect to the operating window 14*a* of the switch mechanism casing 14 by means of a shaft 32, but is pulled by means of a spring, stretched between itself and an interlock magnet 33 that acts as an interlock device setting the locked condition of the manual operating facility. Thus it normally covers the manual operating shaft 29. The position detector 34 having a light-transmission part 34*a*, a light-receipt part 34*b* and a base 34*c* is provided near the shutter 31 and is arranged so that when the shutter 31 is closed, the light from the light-transmission part 34*a* passes to the light-receipt part 34*b* after being reflected by a board 35. The shutter 31 is provided with a handle 36 for exposing the manual operating shaft 29 when it is turned. As shown in FIG. 6, the optical control unit 50 connected with the position detectors 34 and 41 is provided on a control panel C that is arranged separately from the operating unit 9 and has a signal-transmission part 50*a*, a signal-receipt part 50*b* and an O/E converter 50*c* for converting this light pulse signal into a digital electrical signal and which is connected by means of this O/E converter 50*c* to an A/D converter 53 that forms the electrical control circuit. This A/D converter 53 is connected to a motor controller 54 to lock the electrical control of the isolator drive motor 25 in response to a command from the position detector 34 that is associated with the interlock magnet. The A/D converter 53 is also connected to an output relay 55 that is actuated in response to a command from the position detector 41 that is associated with the switch contacts. The output relay 55 is connected to a display unit 58 for verifying completion of the operation, and to the motor controller 54 to deliver motor operation start and stop commands. On the input side of the motor controller 54 there is also connected a power source 57 and an isolator switching signal closing unit 56, while the drive motor 25 is connected to the output side. In the embodiment constructed as above, when the isolator is in a condition in which manual switching operation is inappropriate, the interlock magnet 33 is not excited, and its iron core is in a non-attracting position. When the position detector 34 detects from the position of this shatter 31 that switching operation by the motor is now possible, it delivers a pulse signal to that effect, which is received by the signal-receiving part 50*b* of the optical control unit 50. This is converted to an electrical signal by the O/E converter 50*c* and then into a digital signal by the analog/digital conversion carried out by the A/D converter 53 which is associated with the electrical control circuit. This provides the command to the motor controller 54 that makes possible driving of the motor 25.

When in this condition a switching signal is supplied from the closing unit 56 to the motor controller 54, the circuit linking the power source to the motor 25 is closed. This causes the motor 25 to be driven. As shown in FIG. 3, its rotation is transmitted through the reduction gear 26 to the ratchets 28*a* and 28*b*. The wheel 27 and drive shaft 21, which is linked to it, are turned by these ratchets 28*a* and 28*b*. When this happens, the spring shaft 18, which is linked to the drive shaft 21 by means of the cam 20, is rotated, causing the drive spring 17 to be compressed and to store energy with the upwards rotation of the lever 19. When the lever 19 passes over the top dead centre, the force of the drive spring 17 is released, causing the spring shaft 18 to be rapidly rotated. This rotates the main shaft 10, to which it is linked through the cam 16, and makes the insulating rod 8, which is connected to this main shaft 10 by means of link 11, perform a reciprocating motion. This, in turn, caused the fixed and movable contacts 3 and 4 to perform a switching action.

The main shaft 10 is rotated by means of the stored energy which is released from the drive spring 17 so that the operation of switching the isolator is commenced. The position of the contacts 3 and 4 resulting from the switching operation is detected by the position detector 41 provided on the main shaft. When this position detector 41 detects that the contacts have shifted to the position at which the motor 25 is to stop, it emits a signal, which is delivered to the optical controller 50 and thence, by means of the O/E converter 50C, A/D converter 53, and output relay 55, to the motor controller 54, stopping the motor 25. When the position detector 41 detects that the contacts have reached the position in which switch operation has been completed after stopping of the motor 25, the signal which it emits is transmitted to the output relay 55 by means of the optical control unit 50.

An indication confirming that the operation has been carried out is displayed on the display unit 58 on the control panel c, in response to a command from the output relay.

In contrast, when the interlock condition exists, so that manual switching operation is possible, the interlock magnet 33 is excited. The position of the shatter 31 is detected by the position detector 34, which delivers a corresponding signal to the optical control unit 50 by means of optical cable 52. This signal which is delivered to the optical control unit 50 is supplied to the motor controller 54 by means of the O/E converter 50C and A/D converter 53 so that, even if the electrical switching signal is closed, this controller 54 is set to a locked condition in which driving of the motor 25 is not performed. In this state, the switching operation of the contacts is performed in the same way as in the previous type of isolator, by opening the shutter 31 and turning the manual operating shaft 29 with a handle 30, but completion of the switching operation is displayed on a control panel, after it has been detected by the position detector 41 provided on the main shaft, by means of the optical control unit 50 and output relay 55.

Due to the construction adopted in the above embodiment, a considerable saving can be made in the amount of wiring, because, in the operating unit, electrical wiring is only required for the motor and interlock magnet. Since the various position detectors perform their detection by utilizing the change in the amount of light reflected or the pulse width of light outputted from an optical control unit to ascertain the position of the switch contacts or the interlock condition, by connecting these position detectors to the optical control unit with a light cable, the auxiliary switch etc., which previously required a large amount of wiring, is eliminated. And since all of the many contacts are arranged on the output relay that is connected to the optical control unit associated with this control panel, particularly all of the wiring can be on the side of the control panel and thus, be positioned remote from the switches with the operating unit and the control panel being linked merely by a light cable. This makes it possible to cut down the number of steps necessary in on-site installation. Spurious operation due to vibration of the operating unit when the switching operation is carried out can therefore be eliminated. In particular, there previously existed an inconvenience that electrostatic coupling allowed main circuit surges resulting from switch action to be induced into the control circuit through the casing, with the present embodiment, there is no risk of surges causing problems with the components of the control circuit. This is true because there is only a small amount of wiring, comprising the control cables, etc., which is adjacent the grounded tank of the gas-insulated switchgear.

Figure 7:
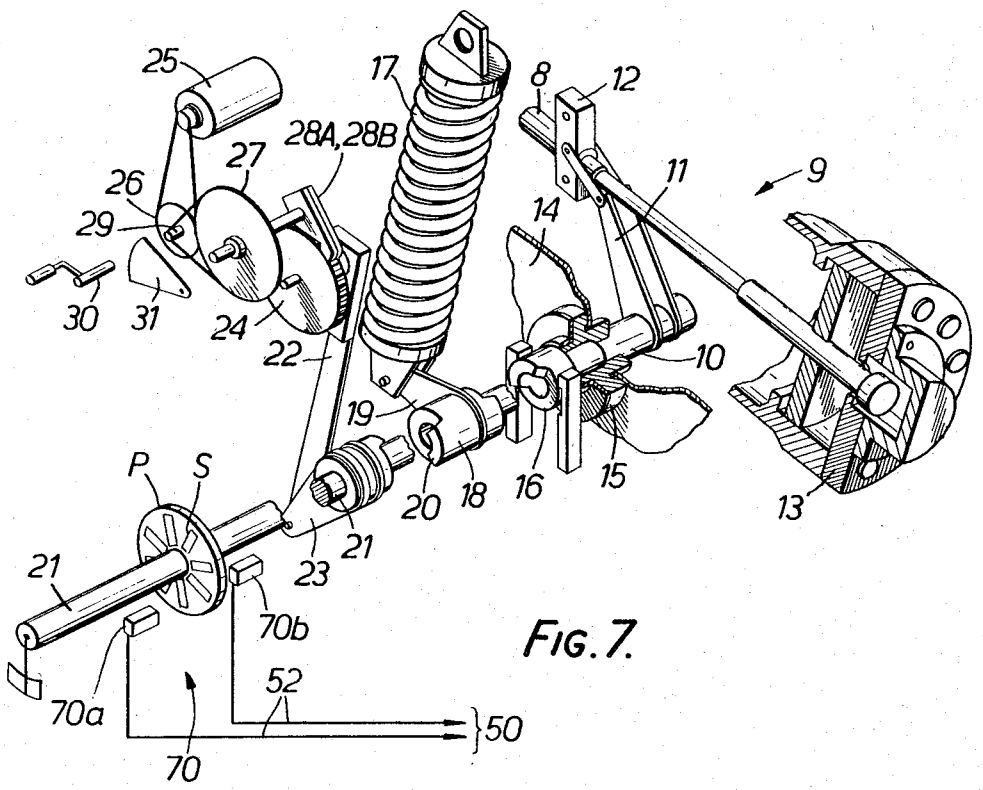
FIG. 7 is a perspective view of an operating unit of a disconnecting switch according to another embodiment of the present invention.

Examples of position detectors 40 which may be used are as follow:

(1) As shown in FIG. 7 a detector 70 wherein an optical stop p formed with slits S is mounted on the main shaft 10, predetermined light pulses are projected onto the stop p from the signal-transmission part 50*a* of the optical control unit 50 by means of a light-transmission part 70*a* and the progressive variation of the interference fringes produced by this light in the region of the slits depending on the angle of rotation of the main shaft is detected as a variation in the pulse width of the projected light pulses or as a variation in the amount of light, which is detected by a signal-receiving part 50*b* of the optical control unit 50 by means of a light-receipt part 70*b*.

(2) A detector wherein, depending on the position of the operating rod of the contacts or the main shaft, an optical stop provided thereon is moved, thereby progressively cutting off light emitted from the signal transmission part 50*a* with the variation in the amount of this light being detected by the signal-receiving part 50*b*.

Figure 8:
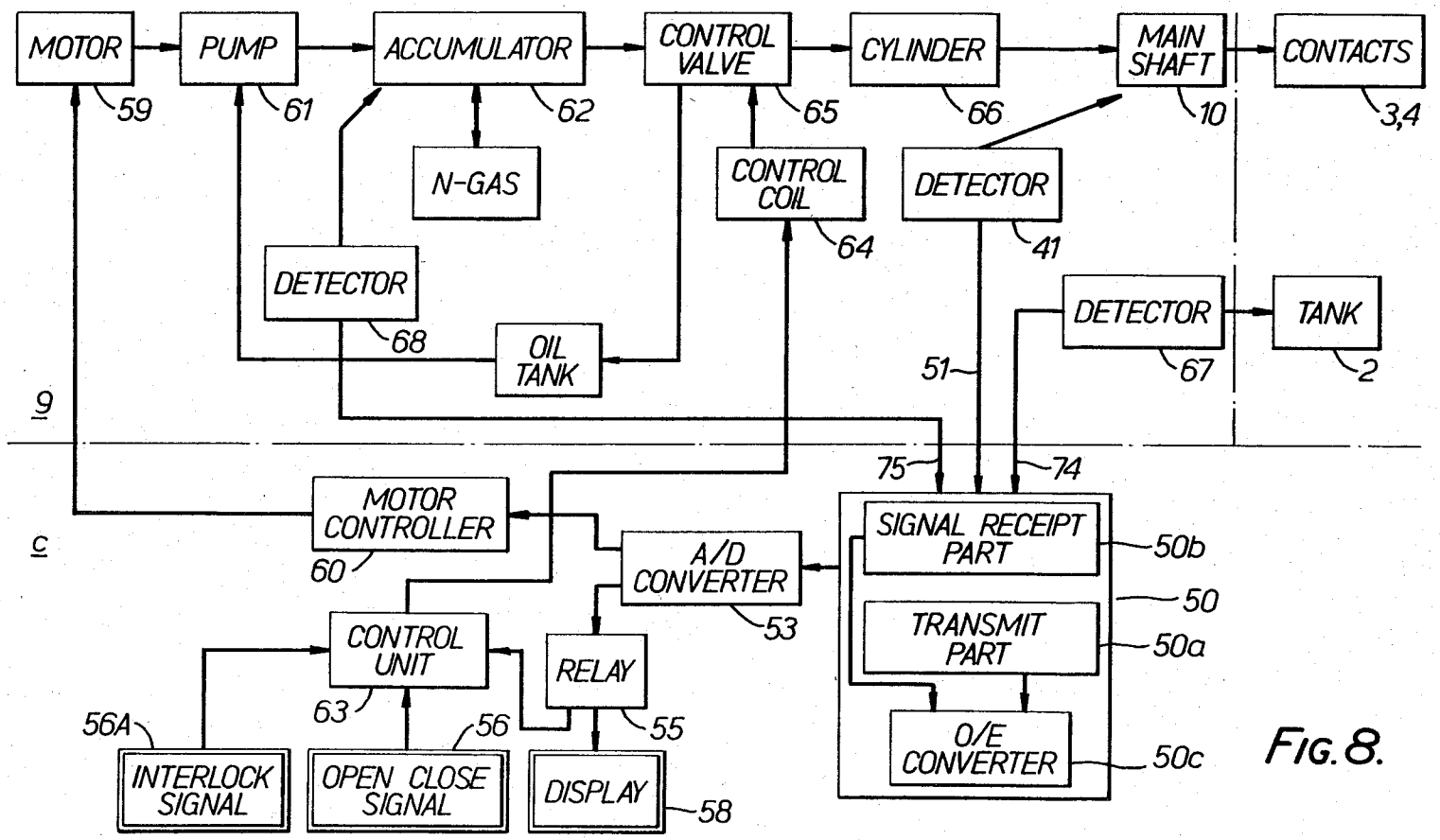
FIG. 8 is a block diagram of a disconnecting switch according to another embodiment of the present invention.

It should be noted that the scope of this invention is not restricted only to motor-driven and manually-driven isolators as described above. As shown by the block diagram of FIG. 8, this invention could also be applied to operating units driven by fluid pressure, such as for example an oil-pressure driven circuit-breaker or the like. In such a circuit-breaker, a motor 59 is driven in response to a command from a motor controller 60, causing an oil-pressure pump 61 to be actuated to store energy in an accumulator 62. When a control coil 64 is excited by a switching signal from a control unit 63 associated with the control panel, a control valve 65 is actuated, permitting the fluid pressure of the accumulator to move the cylinder 66, which rotates the main shaft to perform the switching operation.

In order for such a circuit-breaker to operate properly, it is necessary to ensure that there is the proper amount of fluid pressure to drive the switch mechanism, and the proper insulating gas pressure in the circuit breaker tank. These factors represent the locking conditions that determine whether or not the switching operation should be performed. In addition to the detector 41 which detects the switching position of the switch contacts, there are also provided a detector 67 for the gas pressure inside the earthed tank, and a detector 68 for the fluid pressure of the operating unit accumulator 62. These detectors 67 and 68 constitute the means for deciding the locking condition and are connected with the optical control unit by means of light cables 74 and 75.

Figure 9:
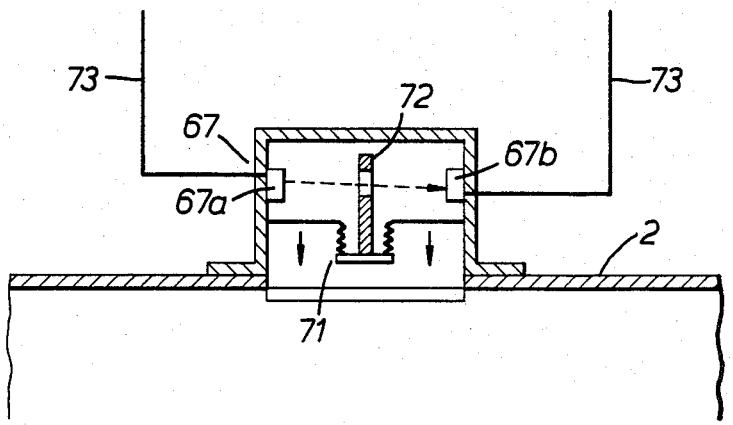
FIG. 9 is a fragmentary sectional view of a detector for pressure change.

These position detectors 67 and 68 detect pressure variations, as shown in FIG. 9, as mechanical displacements by means of a bellows 71 or piston arrangement. This displacement is then processed optically by the detector 67 having a light-transmission part 67*a* and a light-receipt part 67*b* as in the preceding embodiment and outputted to the optical control unit 50. Each of the detectors 67 and 68 is connected to the optical control unit 50 by a respective optical cable 73. As in the preceding embodiment, this optical control unit 50 is connected by means of an A/D converter 53 to a motor controller 60 and output relay 55. The output relay 55 is connected to a display unit 58 for verifying actuation and to a controller 63 for controlling switching operation.

Thus, even when this invention is applied to a circuit breaker wherein the switching action is performed by means of fluid pressure, since the state of the switch contacts is detected as an optical signal using the position detector A, this optical signal is subjected to opto-electrical conversion by the optical control unit 50. Likewise, a switching control signal and operation verification signal are delivered from the output relay 55, and detection of the locking conditions represented by operating fluid pressure and gas pressure is also performed by a position detector utilizing light signals. This eliminates the need for electrical contacts or an auxiliary switch associated with the operating unit. Also, the amount of wiring required can be cut down and resistance to environmental variations improved. Furthermore, since gas pressure detection was previously performed by a pressure switch, when the pressure was actually in the neighborhood of the set value, problems such as false alarms and chattering occurred due to operating vibration on switching of the contacts. In contrast, when, as in the embodiment, a pressure-produced displacement is detected mechanically, and this is subjected to optical processing in the position detector, the above problems due to pressure switches are eliminated. Since the optical signal generator 50*a* of the optical control unit 50 in this invention is in general constituted by an electronic component, the life of the light-emitting element is determined by the applied voltage. Longer life can therefore be attained if arrangements are made to generate the optical signal only when necessary, by a circuit construction in which the light-emitting element is actuated on receipt of an operating signal from the switch mechanism.

As explained above, with this invention, the provision of electrical contacts within the operating unit is unnecessary, so that an electrical switch can be provided which is of high reliability in operation over a long period, this is possible because of the lowering of resistance to spurious operation which is occasioned by these electrical contacts, and the elimination of inconveniences such as increased complexity of wiring.

What is claimed as new and is intended to be secured by Letters Patent is:

1. An electrical switchgear which comprises:
fixed and movable contacts arranged in a tank filled with insulating gas;
a switch mechanism driving said movable contact, and including a mainshaft;
an operating unit connected to said main shaft of said switch mechanism;
a first position detector means for optically detecting the operating state of said movable contact;
an optical control unit being connected to said first detector by means of an optical cable, said optical control unit outputting a signal to said operating unit for controlling said switch mechanism.

2. An electrical switchgear according to claim 1 said first detector means comprises a colored disk;
a light emitting means for outputting light to said disk; and wherein said first detector means detects the amount of said outputted light which is reflected from said disk.

3. An electrical switchgear which comprises:
fixed and movable contacts arranged in a tank filled with insulating gas;
a switch mechanism driving said movable contact and including a main shaft;
an operating unit connected to said main shaft of said switch mechanism;
a first position detector means for optically detecting the operating state of said movable contact;
a second position detector means for optically detecting the possibility of the manual operation of said movable contact;
an optical control unit being connected with said first and second detector by means of an optical cable, said optical control unit outputting a signal to said operating unit for controlling said switch mechanism.

4. An electrical switchgear according to claim 3, said second detector means includes means for detecting the presence of light from a reflection means.

5. An electrical switchgear which comprises:
fixed and movable contacts arranged in a tank filled with insulating gas;
a switch mechanism driving said movable contact and including a main shaft;
an operating unit connected to said main shaft of said switch mechanism;
a first position detector means for optically detecting the operating state of said movable contact;
a second detector means for detecting optically the pressure of said insulating gas in said tank;
a third detector means for detecting optically the pressure of an accumulator in said operating unit;
an optical control unit being connected with said first, second and third detectors by means of an optical cable, said optical control unit outputting a signal to said operating unit for controlling said switch mechanism.

* * * * *